United States Patent [19]

Gotoh

[11] 4,365,385

[45] Dec. 28, 1982

[54] HINGE CLAMP

[75] Inventor: Akio Gotoh, Yokohama, Japan

[73] Assignee: Katoh Electrical Machinery Co. Ltd., Tokyo, Japan

[21] Appl. No.: 198,971

[22] PCT Filed: Oct. 9, 1979

[86] PCT No.: PCT/JP79/00255

§ 371 Date: Jun. 9, 1980

§ 102(e) Date: May 27, 1980

[87] PCT Pub. No.: WO80/00688

PCT Pub. Date: Apr. 17, 1980

[30] Foreign Application Priority Data

Oct. 9, 1978 [JP] Japan ..... 53/138761[U]

[51] Int. Cl.[3] ..... E05D 5/06

[52] U.S. Cl. ..... 16/382

[58] Field of Search ..... 16/158, 382, 390

[56] References Cited

U.S. PATENT DOCUMENTS 2,852,804 9/1958 Alexander ..... 16/158

3,710,415 1/1973 Wilson ..... 16/158 X

FOREIGN PATENT DOCUMENTS 390080 7/1965 Switzerland ..... 16/158

*Primary Examiner*—Werner H. Schroeder

*Assistant Examiner*—Andrew M. Falik

*Attorney, Agent, or Firm*—George B. Oujevolk

[57] ABSTRACT

A hinge arrangement for a record player to properly distribute the load over a glass cover and avoid imposing an unduly large load around the mounting holes. There is provided a cover retainer with a pair of hinge plates having side plate portions which define a receiving space for a pair of anchoring lugs and a hinge pin, on one of said hinge plates. The side portions on the other hinge plate are received by and fixed in said defined space and retained at the center point by the anchoring lugs so as to prevent the other hinge plate from rotating back away from the one hinge plate. Attaching screws are provided on one of said hinge plates for fixing the cover inserted in the cover retainer.

1 Claim, 5 Drawing Figures

HINGE CLAMP

BACKGROUND OF THE INVENTION

The present invention relates to a hinge used in connecting a glass cover to a record player.

BRIEF DESCRIPTION OF THE PRIOR ART

Heretofore, a hinge for a glass cover of a record player has generally consisted of a pair of hinge plates designed to receive the rear end of a glass cover having screw bores so that the glass cover could be tightly fastened to the hinge by means of screws which are fastened across the two hinge plates through the mounting holes of the glass cover so as to sandwich the glass cover between the hinge plates. In this conventional construction, a considerable load is imposed on the area around the mounting holes of the glass cover during repair work or during the opening and closing motion of the glass cover, which can cause breakage. In addition, this conventional construction requires forming mounting holes in the glass cover which is difficult.

SUMMARY OF THE INVENTION

It is therefore an object of the invention to provide a hinge for pivotally securing a glass cover to a record player cabinet which is capable of securing the glass cover to the hinge without using mounting holes in the glass cover. To this end, according to the inventive concept, there is provided a hinge having a cover retainer which has a pair of hinge plates, one of the hinge plates having side plates pivotally secured to a hinge pin and which is provided with a pair of anchoring lugs; while the other hinge plate has one side portion inserted between the side plates of the one hinge plate and, both side portions of the other hinge plate are engaged substantially at the center portion by the anchoring lugs so as to prevent this other hinge plate from rotating away from the one hinge plate. At least one of the pair of hinge plates has screws for securing the rear end portion of the glass cover inserted into the cover retainer. This arrangement permits the glass cover to be secured to the cover retainer of the hinge without the necessity of forming a mounting hole in the glass cover.

DETAILED DESCRIPTION OF THE INVENTION

Figure 1:
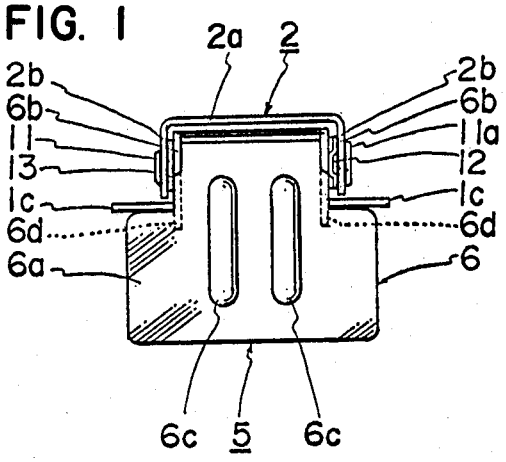
FIG. 1 is a plan view of a hinge for pivotally securing a cover.
Figure 2:
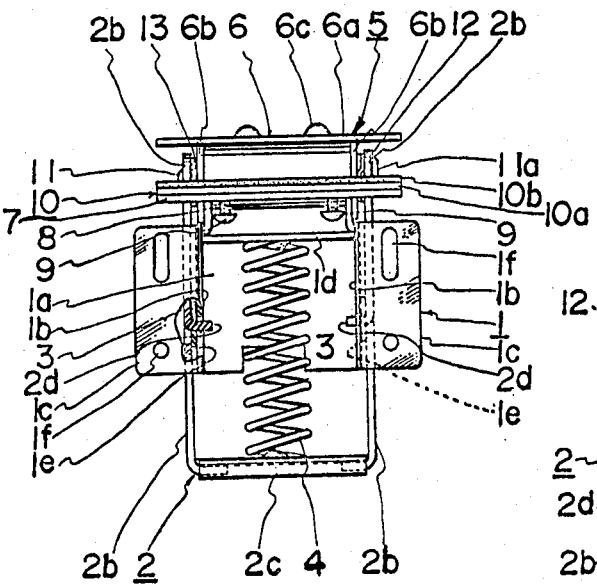
FIG. 2 is a front elevational view of the hinge shown in FIG. 1.
Figure 3:
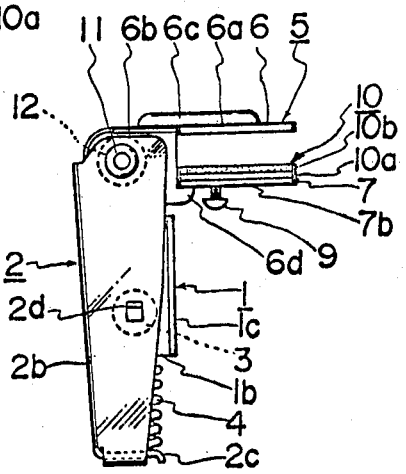
FIG. 3 is a left side elevational view of the hinge shown in FIG. 1.

The best mode for carrying out the invention will be described with reference to the drawings. Referring to FIGS. 1 to 3, a reference numeral 1 denotes a hinge bracket which is formed of an iron sheet bent so that it has a convex shape, comprising a base plate portion 1*a*, two side plates 1*b*,1*b*, attaching plates 1*c*, 1*c* and top plate 1*d*. A hinge pin 8 is attached to the upper end portions of the side plates 1*b*,1*b*. The side plates 1*b*,1*b* are slightly bent inwards at their mid portions to form a shelf-like portion to hold the top plate 1*d*. Further, vertical grooves 1*e*,1*e* are formed in the side plates 1*b*,1*b*. Attaching bores 1*f*,1*f* are formed in the attaching plates 1*c*,1*c*.

A spring case designated 64 reference numeral 2 is formed also of an iron sheet bent to have a substantially bracket-shaped cross-section and to have a base plate portion 2*a*, two side plate portions 2*b*,2*b* and a bottom plate portion 2*c*. Guide projections 2*d*,2*d* are formed substantially at center portions of the side plate portions 2*b*,2*b* so as to project inwards. The lower ends of the side plates 2*d*,2*d* are bent slightly inwards to hold the bottom plate 2*c*.

A hinge bracket 1 is held by the spring case 2. The aforementioned guide grooves 1*e*,1*e* receive guide projections 2*d*,2*d* of the spring case 2. A friction member 3 such as fibers of the like is inserted between the side plates 1*b* and 2*b* at each side through the guide projections 2*d*,2*d*. A spring 4 having a tension somewhat smaller than the weight of the glass cover is placed so as to act between the top plate 1*d* of the hinge bracket 1 and the bottom plate 2*c* of the spring case 2.

A reference numeral 5 designates a cover retainer formed by a pair of hinge plates 6,7. The front end of the cover retainer 5, when it is not used for securing the cover, is generally biased upwardly through the medium of the spring case 2, by means of the spring 4. In the drawings, however, the cover retainer 5 is illustrated to take a depressed position overcoming the force of the spring 4 to assume a position perpendicular to the hinge bracket 1.

One of the hinge plates in the upper position is formed by a base plate 6*a* having reinforcement ribs 6*c*,6*c*, and two side plates 6*b*,6*b* having shelf-like anchoring lugs 6*d*,6*d*. A part of the base plate 6*a* is deflected to project into the space between the side plates 6*b*,6*b* to prevent the latter from being bent inwardly.

Figure 4:
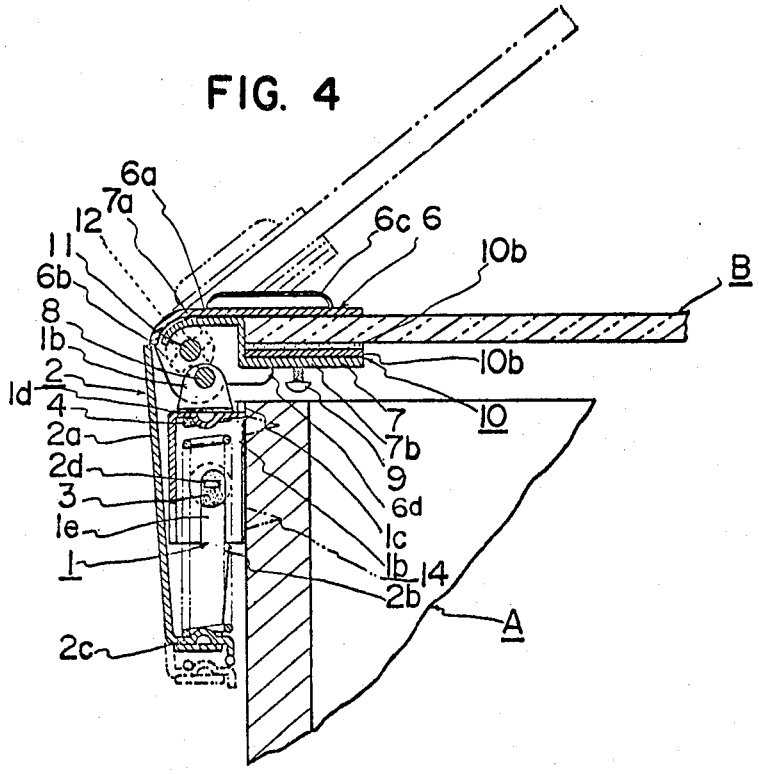
FIG. 4 is a left side elevational view of the hinge connected between a cabinet and a glass cover; and, FIG. 5 is an exploded perspective view of the hinge contemplated herein.
Figure 5:
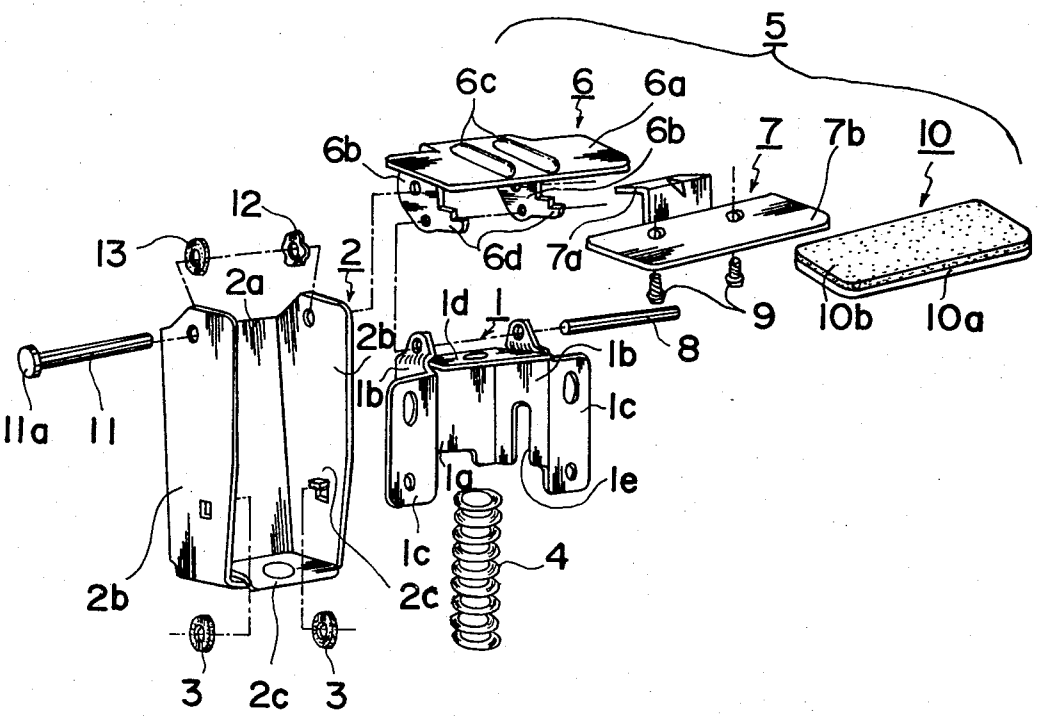

Another hinge plate 7 is bent at its side surface to have a crank-like shape as shown in FIG. 4 to form an insertible fixing portion 7*a* and a cover receiving portion 7*b*. The insertible fixing portion 7*a* is inserted between the side plate 6*b*,6*b* of the hinge plate 6 and is fixed to the inner bottom portion of the base plate portion 6*a* of the hinge plate 6 by welding or the like measure. The cover receiving portion 7*b* at about the center portion of the hinge plate 7 is retained by the anchoring lugs 6*d*,6*d* and, then, after attaching fixing screws 9,9 to the cover receiving portion 7*b*, a packing 10 composed of an iron plate 10*a* and a rubber plate 10*b* is superimposed on to the iron plate 10*a* and is placed on the side of the upper surface of the hinge plate 7 opposite to the hinge plate 6.

The side plate portions 6*b*,6*b* of the hinge plate 6 formed by the cover retainer 5 are pivotally secured to the hinge pin 8 which is attached to the upper end portions of the side plates 1*b*,1*b* of the hinge bracket 1, and is connected also to the side plates 2*b*,2*b* of the spring case 2 by means of a pin 11.

The attaching of the glass cover B to the cover retainer 5 is made in the following manner: The rear end portion of the glass cover B is placed between the hinge plate 6 and the packing 10. Thereafter, as the attaching screws 9,9 are tightened, the rear end portion of the glass cover B is pressed against the hinge plate 6 by pressure applied through the packing 10 held by the crank-shaped insertible fixing portion 7*a* attached to the inside of the base panel 6*a* of the other hinge plate 6. By this construction, the glass cover B can be secured to the hinge, without being provided with any mounting hole.

As another form of the cover retainer 5, insertible fixing portion *7a* of the hinge plate 7 is wound round the hinge pin 8 or, alternatively, the insertible fixing portion is made to contact the hinge pin 8. Such an alternative arrangement provides an equivalent effect to that produced by the described embodiment.

It is possible to secure the rear end of the glass cover B to the cover retainer 5, even if the packing 10 is omitted. However, the use of packing consisting solely of the rubber plate is effective in preventing the withdrawal or dropping of the glass cover B. Further, the composite packing composed of the iron plate 10*a* and the rubber plate 10*b* superimposed one on the other effectively distributes the pressure when the fixing screws 9,9 are tightened, so that the glass cover B is protected from local concentration of pressure which might be generated to cause the breakage of the glass cover.

Another advantage is as follows. In the conventional hinge of the kind described, the spring case 2 and the hinge plate 6 are connected to each other by means of eyelets no frictional member nor resilient member is interposed between the overlapping side plates 2*b*,2*b* and 6*b*,6*b*. According to the invention, the eyelet is substituted by a caulked pin 11 which is inserted through a frictional member 12 such as of fibers and a resilient member 13 such as a spring washer interposed between overlapped portions of the side plates 2*b*,2*b* and 6*b*,6*b*. At the same time, the head 11*a* of the pin 11 is caulked at a suitble pressure. As a result, a frictional resistance is caused during the rotation of the hinge plate 6 so that the opening and closing motion of the glass cover B is smooth and an abrupt jumping up of cover glass cover B is avoided even if the force of spring 4 increases.

In the conventional construction, a spring retainer for retaining one end of the spring 4 is separetely suspended in the spring case 2. Alternatively, a spring rod is provided on the bottom plate 2*c* of the spring case 2 to extend upward through the bottom plate of the hinge bracket 1, and the spring is disposed to act between the bottom plate of the bracket 1 and a spring retainer plate screwed to the upper end of the screw rod. According to the invention, however, the spring 4 is disposed to act between the top plate 1*d* of the hinge bracket 1 and the bottom plate 2*c* of the spring case 2 to simplify the construction. This arrangement does not cause undersirable bending of the top plate 1*d* and the bottom plate 2*c* bearing the spring force of the spring 4, because the top plate 1*d* and the bottom plate 2*c* are held by the shelf-like portion provided on the side plates 1*b*,1*b* and the lower ends of the side plates 2*b*,2*b*, respectively.

FIG. 4 shows an example of use of the hinge in accordance with the invention. The attaching plates 1*c*,1*c* of the hinge bracket 1 are fitted on the upper rear end portion of the cabinet A of an instrument such as a record player or the like, by means of screws 14,14. At the same time, the rear end portion of the glass cover B is secured to the cover retainer 5.

In FIG. 4, the closed condition of glass cover B is represented by full line. In this condition, the spring 4 is in the fully compressed state to press the bottom plate 2*c* of the spring case 2 downward so as to cause a tendency of counter-clockwise rotation of the hinge plate 6 of the cover retainer 5 to open the glass cover B. However, since the spring force of the spring 4 is overcome by the weight of the glass cover B, the natural opening of the glass cover B is avoided.

Then, as the glass cover B is opened, the cover retainer 5 is rotated counter-clockwise, and the spring case 2 is moved downward as the guide projections 2*d*,2*d* are guided by the guide grooves 1*e*,1*e*, so as to open the glass cover B. In this condition, the spring 4 is exerting a force to cause a tendency of counter-clockwise rotation of the hinge plate 6 of the cover retainer 5, through the medium of the spring case 2, so that the weight of the glass cover B is nullified by this biasing force to negate the feeling of weight of the glass cover B.

The glass cover B thus opened is stopped as the caulked pin 11 abuts against one side of the upper portions of the side plates 1*b*,1*b* of the hinge bracket 1, so that a further movement of the glass cover B in the opening direction does not occur. Thus, the opened glass cover B is maintained by the force of the spring 4.

For closing the glass cover B from the opened condition, the members and parts operate in the reverse manner to the opening operation. In this case, as the glass cover B is not suddenly closed by the spring force of the spring 4 which acts to negate the weight of the glass cover B, the undersirable breakage of the glass cover B is eliminated.

During the opening and closing of the glass cover B, a moderate braking effect is produced by the frictional contact of the resilient member 12 and the frictional member 13 interposed between the side plates 6*b*,6*b* of the hinge plate 6 and corresponding side plates 2*b*,2*b* of the spring case 2, as well as the friction members 3,3 interposed between the mid portions of side plates 2*b*,2*b* of the spring case 2 and the corresponding side plates 1*b*,1*b* of the hinge bracket 1. As a result, the opening and closing operation can be made without any jolt or rattle. At the same time, the undesirable jumping up of the cover due to the spring force which becomes annoying in some opening positions of the cover B is avoided. And it is possible to stabilize the glass cover at an intermediate opening angle at which the spring force of the spring 4 and the weightof the glass cover B balance.

The object of the invention can be achieved by adopting other constructions of parts of the hinge besides the cover retainer 5. For instance, it is possible to modify the hinge of the described embodiment by the use of a torsion coiled spring, tensile coil spring and the like, or the hinge can be constructed even without using any spring.

The best mode for carrying out the invention, however, is obtained by applying the cover retainer 5 to the hinge of the above-described construction.

What is claimed is:

1. A hinge for opening and closing a cover of a record player, comprising in combination:

(a) a cover retainer (5) with a pair of hinge plates (6, 7);

(b) side plate portions (6*b*, 6*b*) on one of said hinge plates (6), a hinge pin (8) pivotally supported by said side plate portions (6*b*, 6*b*), said side plate portions defining a receiving space and being provided with a pair of anchoring lugs (6*d*, 6*d*);

(c) a side portion on said other hinge plate (7), said side portion being received by and fixed in said defined space and being retained substantially at its center point by said anchoring lugs (6*d*, 6*d*) so as to prevent said other hinge plate (7) from rotating back away from the one hinge plate (6); and, (d) at least one of said hinge plates (6, 7) being provided with attaching screws (9, 9) for fixing the cover inserted in said cover retainer.

* * * * *